US008413668B2

(12) United States Patent
Kudo

(10) Patent No.: US 8,413,668 B2
(45) Date of Patent: Apr. 9, 2013

(54) MASCARA APPLYING DEVICE

(75) Inventor: Saori Kudo, Kawaguchi (JP)

(73) Assignee: Tokiwa Corporation, Nakatsugawa-shi, Gifu (JP)

( * ) Notice: Subject to any disclaimer, the term of this patent is extended or adjusted under 35 U.S.C. 154(b) by 0 days.

(21) Appl. No.: 13/181,552

(22) Filed: Jul. 13, 2011

(65) Prior Publication Data

US 2012/0034015 A1 Feb. 9, 2012

(30) Foreign Application Priority Data

Aug. 4, 2010 (JP) ..... 2010-175594

(51) Int. Cl.
*A45D 40/26* (2006.01)
*A45D 33/00* (2006.01)

(52) U.S. Cl.
USPC ..... 132/218; 401/130

(58) Field of Classification Search ..... 132/218, 132/317; 401/126, 129, 130, 127
See application file for complete search history.

(56) References Cited

U.S. PATENT DOCUMENTS 2,007,245 A * 7/1935 Gimonet ..... 132/218
2,477,245 A * 7/1949 Giddings et al. ..... 132/125
2004/0112399 A1* 6/2004 Chant ..... 132/218

FOREIGN PATENT DOCUMENTS

EP 614630 A1 * 9/1994

* cited by examiner

*Primary Examiner* — Robyn Doan
(74) *Attorney, Agent, or Firm* — Bacon & Thomas, PLLC

(57) ABSTRACT

To quickly apply a mascara to cilia without unevenness, a state capable of applying a mascara (L) is more quickly achieved in comparison with a conventional art by constructing a guide path (34*d*) guiding the mascara (L) extruded from an accommodating portion (1*a*) as a straight linear route, and by opening an opening (4*c*) flowing out the mascara (L) to the external on the linear route, and the mascara (L) is more evenly distributed between adjacent arch type applying portions (4*e*, 4*e*) in comparison with the conventional art by opening the opening (4*c*) on the linear route as mentioned above, and by structuring an applying body (4*x*) for applying the mascara (L) to cilia as a plurality of arch type applying portions (4*e*) which are arranged in line along the opening (4*c*) while straddling the opening (4*c*) from an outer side and have an arch shape.

4 Claims, 4 Drawing Sheets

MASCARA APPLYING DEVICE

BACKGROUND OF THE INVENTION

1. Field of the Invention

The present invention relates to a mascara applying device for applying a mascara to cilia.

2. Description of the Conventional Art

Conventionally, as the mascara applying device, there has been known a mascara applying device provided with a hollow rod which feeds a mascara, and a head which is to connected to the hollow head and which the mascara is fed, wherein the head is provided with a cylindrical element approximately coaxially connected to the hollow rod, and hollow arcuate portions connected to a peripheral surface of the cylindrical element so as to swell out and positioned so as to be eccentric with respect to the hollow rod, a lot of slits formed in such a shape as to cut into the vicinity of a bottom portion of the swelling portion from a front end of the swelling portion and slice the arcuate portions are provided in line in the arcuate portions so as to be spaced along an axis of the arcuate portions, whereby a space joining inner and outer sides of the arcuate portions is formed between the adjacent arcuate portions serving as applying portions, the mascara is distributed from each of the slits of the arcuate portions so as to flow out after passing through the hollow rod and the cylindrical element at a time of use, and the flowing out mascara can be applied to cilia by the arcuate portions (refer, for example, to Japanese National Publication of Translated Version No. 2001-502573).

SUMMARY OF THE INVENTION

Problem to be Solved by the Invention

However, in the mascara applying device mentioned above, since the mascara within the hollow rod is distributed to each of the slits so as to flow out after changing its flow direction to a direction which is orthogonal to the hollow rod, at a time of flowing into the cylindrical element and heading for the arcuate portions connected to the peripheral surface of the cylindrical element, there has been such a problem that it is impossible to quickly achieve a state capable of applying the mascara.

Further, since a plurality of slits are provided in line along a direction in which the mascara flows into the head, the mascara flows out in sequence from the slit at an inflow side of the mascara, and there has been such a problem that the mascara can not be evenly distributed to each of the slits so as to be applied to the cilia without unevenness.

Accordingly, an object of the present invention is to provide a mascara applying device which can quickly achieve a state capable of applying a mascara, and can apply the mascara to cilia without unevenness.

Means for Solving the Problem

The mascara applying device in accordance with the present invention is a mascara applying device comprising:

an accommodating portion accommodating a mascara;

a guide path guiding the mascara extruded from the accommodating portion to an opening in a front end; and an applying body for applying the mascara flowing out of the opening to cilia, wherein the applying body is provided with a plurality of arch type applying portions which are arranged in line along the opening while straddling the opening from an outer side and have an arch shape, the guide path is formed as a linear route, and the opening is opened onto the linear route.

In accordance with the mascara applying device mentioned above, since the guide path guiding the mascara extruded from the accommodating portion is formed as the straight linear route, and the opening for flowing out the mascara to an external portion for applying the mascara to the cilia is opened onto the linear route, it is possible to quickly achieve the state capable of applying the mascara in comparison with a conventional art which flows out the mascara to the external portion through an approximately 90 degree bent route. Further, since the opening is opened onto the linear route, and the applying body for applying the mascara flowing out of the opening to the cilia is provided with a plurality of the arch type applying portions which are arranged in line along the opening while straddling the opening from the outer side and have the arch shape, the mascara is more evenly distributed between the adjacent arch type applying portions in comparison with the conventional art in which a plurality of slits are arranged in line along the direction in which the mascara flows into the head, whereby it becomes possible to apply the mascara to the cilia without unevenness.

In this case, a plurality of the arch type applying portions may have different outer shapes from each other. Specifically, for example, it is possible to mix and alternately arrange wide arch type applying portions in which a distance between both legs of a V-shape constructing the arch shape is wide, and narrow arch type applying portions in which the distance between both the legs of the V-shape is narrow, for example. Therefore, it is possible to apply makeup including several variations such as to easily make the cilia voluminous or the like regardless of a skill of a user.

Further, if the applying body has chevron type applying portions which inhibit the mascara from flowing out to an outer side in the in-line arranging direction and have a chevron shape, at outermost side positions in the in-line arranging direction of the in-line arranged arch type applying portions, it is possible to prevent liquid dropping of the mascara to the outer side in the in-line arranging direction by the chevron type applying portions, and it is possible to more quickly achieve the state capable of applying the mascara.

Effect of the Invention

As mentioned above, in accordance with the present invention, it is possible to quickly achieve the state capable of applying the mascara, and it is possible to provide the mascara applying device which can apply the mascara to cilia without unevenness.

DETAILED DESCRIPTION OF PREFERRED EMBODIMENT

Figure 1:
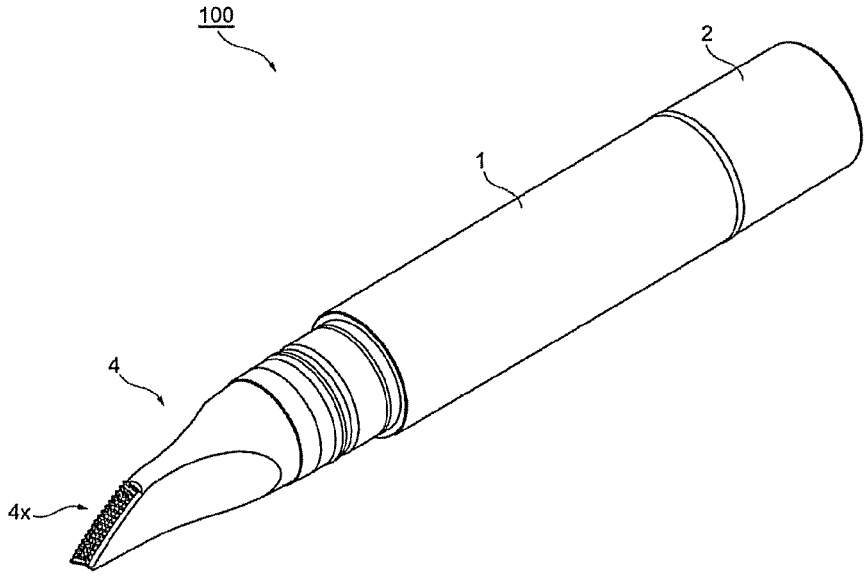
FIG. 1 is an outer appearance perspective view showing a mascara applying device in accordance with an embodiment of the present invention.
Figure 2:
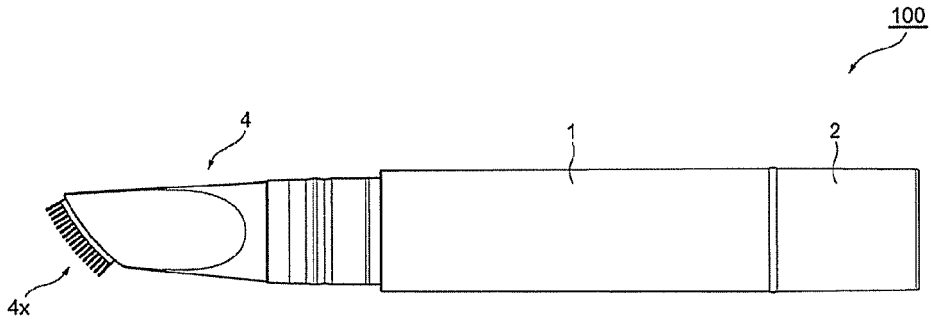
FIG. 2 is a front view of the mascara applying device shown in FIG. 1.
Figure 3:
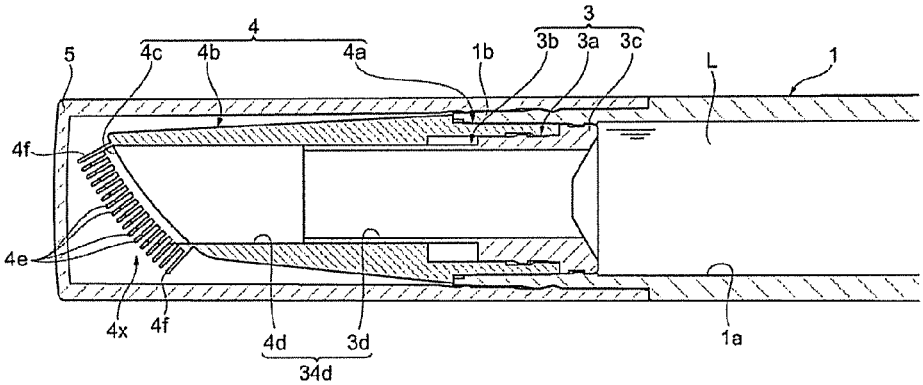
FIG. 3 is a longitudinal sectional view of a front end side of the mascara applying device shown in FIG. 2.
Figure 4:
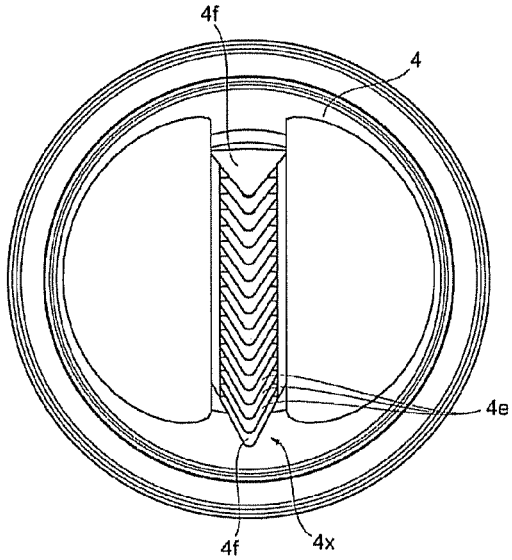
FIG. 4 is a left side view of the mascara applying device shown in FIG. 2.
Figure 5:
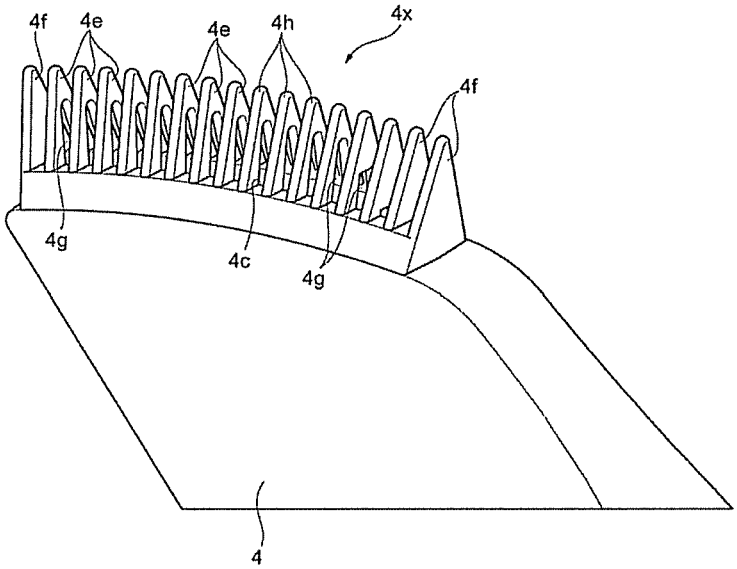
FIG. 5 is a perspective view showing an applying body in FIGS. 1 to 4.
Figure 6:
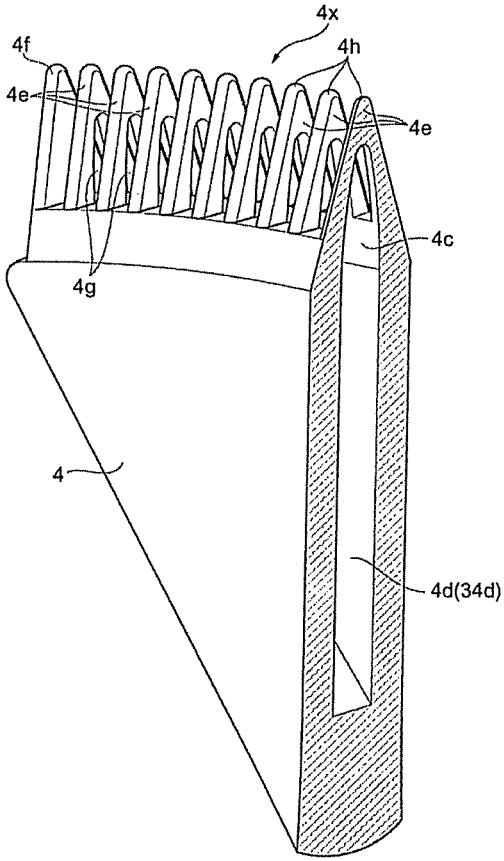
FIG. 6 is a perspective view obtained by cutting the applying body shown in FIG. 5 along a direction which is orthogonal to a direction in which arch type applying portions are arranged in line.
Figure 7:
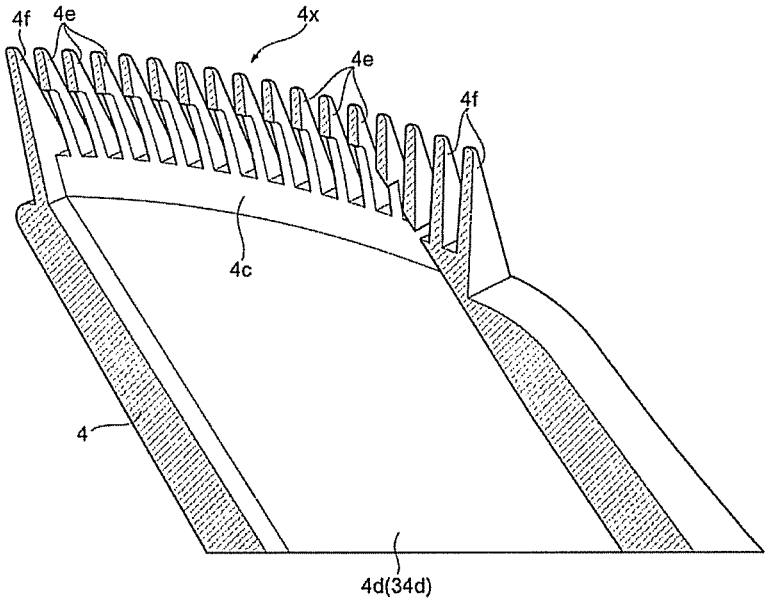
FIG. 7 is a perspective view obtained by cutting the applying body shown in FIG. 5 along the direction in which the arch type applying portions are arranged in lie.

A description will be given below of a preferable embodiment of the mascara applying device in accordance with the present invention with reference to FIGS. 1 to 7. FIGS. 1 and 2 are views each showing an outer appearance of a mascara applying device, FIG. 3 is a longitudinal sectional view of a front end side of the mascara applying device, and FIGS. 4 to 7 are views each showing an applying body. The mascara applying device in accordance with the present embodiment is used at a time when a user applies a mascara to cilia.

As shown in FIGS. 1 to 3, a mascara applying device 100 is provided with a main body tube 1 which accommodates a mascara L, an operation tube 2 which is rotatably connected to a rear portion of the main body tube 1, an induction portion (an induction member) 3 which is fixed to a front end portion of the main body tube 1, and a front tube portion (a front tube) 4 which is fixed to the induction portion 3 in such a manner as to accommodate the induction portion 3 in a tube hole.

The main body tube 1 is constructed in a cylindrical shape, and accommodates the mascara L in an accommodating portion la corresponding to a tube hole.

The operation tube 2 is constructed in a bottomed cylindrical shape, and accommodates an extruding mechanism for extruding the mascara L to a front end side in its inner portion. This extruding mechanism is provided with an engaging mechanism and a rotation preventing mechanism which are publicly known. If the user relatively rotates the operation tube 2 and the main body tube 1 (or the front tube portion 4), the engaging mechanism works, and a moving body constructing the extruding mechanism moves forward so as to extrude the mascara L filled in the accommodating portion la to a front end side. In this case, the extruding mechanism may be structured in whatever manner as long as the moving body can move forward so as to extrude the mascara L to the front end side, and may be structured, for example, as a knock type or the like in place of a rotating type, or may be structured such as to move backward in addition to forward movement.

As shown in FIG. 3, the induction portion 3 is constructed to have a cylindrical shape in its rear portion 3*a*, and have a flat tubular portion 3*b* which is smaller than the cylindrical rear portion 3*a*, at the front side thereof. The flat tubular portion 3*b* is formed in a square tubular shape having a rectangular shape in its cross section (section which is orthogonal to an axial direction). Further, a cylindrical rear portion 3*a* at the rear side thereof enters into a tube of the cylindrical front end portion 1*b* of the main body tube 1 so as to be fitted and fixed.

The front tube portion 4 is constructed to have a cylindrical shape in its rear portion 4*a*, and have a flat tubular portion 4*b* at the front side thereof. A front end surface of the flat tubular portion 4*b* is somewhat inclined with respect to the axial direction in such a manner as to make easy application, and an opening 4*c* which is opened to the front end surface is constructed as an opening for flowing out the mascara L to an outer side of the container so as to be provided for application.

An outer surface of the flat tubular portion 4*b* is constructed such that a distance between two opposed surfaces is narrowed little by little so as to form a flat shape toward a front end side to construct two flat surfaces, as shown in FIGS. 1 and 2. Further, as shown in FIG. 3, a shape of a tube hole of the front tube portion 4 corresponds to a shape of an outer peripheral surface of the induction portion 3, in other words, a rear portion of the tube hole is formed in a circular shape and the front side thereof is formed in a rectangular shape. Therefore, a shape of the opening 4*c* is formed in a rectangular shape. Further, the cylindrical rear portion 4*a* of the front tube portion 4 enters into a portion between the cylindrical front end portion 1*b* of the main body tube 1 and the cylindrical rear portion 3*a* of the induction portion 3, and the rear end surface of the rear portion 4*a* is brought into contact with the annular collar portion 3*c* in the rear end portion of the induction portion 3, whereby the rear portion 4*a* is fitted and fixed to the rear portion 3*a* of the induction portion 3.

As mentioned above, in a state in which the induction portion 3 enters into the front tube portion 4, and the induction portion 3 is arranged so as to be approximately attached closely within the tube hole of the front tube portion 4, the front end portion of the flat tubular portion 3*b* of the induction portion 3 extends to about the middle in the axial direction of the flat tubular portion 4*b* of the front tube portion 4.

Further, a guide path 34*d* guiding the mascara L extruded from the accommodating portion 1*a* in accordance with driving of the extruding mechanism to the opening 4*c* in the front end is constructed by an inner peripheral surface (a tube hole) 3*d* of the induction portion 3, and an inner peripheral surface (a tube hole) 4*d* of the front tube portion 4 at a front side thereof. The guide path 34*d* is a straight linear route.

Further, as shown in FIGS. 3 to 7, the front tube portion 4 is provided with an applying body 4*x* for applying the mascara L flowing out of the opening 4*c* to the cilia, which is an applied portion, in accordance with integral molding. The applying body 4*x* is provided with a plurality of arch type applying portions 4*e* each straddling the opening 4*c* across the outer sides thereof and having an arch shape so as to be arranged in line along a longitudinal direction of the opening 4*c*. In other words, the arch type applying portion 4*e* is formed in an arch shape provided with a concave portion 4*g* which is obtained by recessing a bottom portion of a flat chevron shape toward a peak (an upper side in FIGS. 5 to 7) of the chevron shape.

Further, the applying body 4*x* is provided with at least one or more chevron shaped applying portions 4*f* for inhibiting the mascara L from flowing out to the outer ends in the in-line arranging direction, at outer end positions in the in-line arranging direction from the opening 4*c*, which are outermost end positions in the in-line arranging direction of the arch type applying portions 4*e* arranged in line.

Further, in order to protect the applying body 4*x*, as shown in FIG. 3, a cap 5 covering the front tube portion 4 and the applying body 4*x* is detachably installed to the front end portion 1*b* of the main body tube 1.

In this case, the front tube portion 4 is formed by a PP, and the induction portion 3 is formed by a polyethylene, however, inversely to this, the front tube portion 4 may be formed by the polyethylene and the induction portion 3 may be formed by the PP. Further, a combination of the other materials may be of course employed, or a combination of the same material may be employed.

In accordance with the mascara applying device 100 mentioned above, the mascara L filled in the accommodating portion 1*a* is extruded to the front end side on the basis of an operation (a rotating operation in this case) of a user, immediately arrives at the opening 4*c* in the front end through the guide path 34*d* forming the linear route, and flows out of the opening 4*c*.

At this time, the mascara L from the opening 4*c* is distributed between the adjacent arch type applying portions 4*e* and 4*e* so as to flow out, also flows into between the adjacent arch type applying portions 4*e* and 4*e* through the recessed concave portion 4*g* (flows in the in-line arranging direction mentioned above), well flows out of a portion between the peaks 4*h* and 4*h* of the adjacent arch type applying portions 4*e* and 4*e*, and a portion between the inclined surfaces of the adjacent arch type applying portions 4*e* and 4*e*, and is well provided for application.

In this connection, if the applying portion is formed in a simple chevron shape, the mascara flows out on and on from the portion between the inclined surfaces of the adjacent chevron shapes before the mascara flows out of the portion between the peaks of the adjacent chevron shapes. However, if the applying portion is formed in the arch shape obtained by recessing the bottom portion of the chevron shape such as the present embodiment, the mascara L also flows between the adjacent arch type applying portions 4*e* and 4*e* through the recessed concave portion 4*g*, and therefore the mascara L well flows out of the portion between the peaks 4*h* and 4*h* of the adjacent arch type applying portions 4*e* and 4*e*.

As mentioned above, in the present embodiment, since the guide path 34*d* guiding the mascara L extruded from the accommodating portion 1*a* is constructed as the straight linear route, and the opening 4*c* for flowing out the mascara L to the external portion for applying to the cilia is opened onto the linear route, it is possible to more quickly achieve the state capable of applying the mascara L, in comparison with the conventional art in which the mascara flows out to the external portion after passing through the approximately 90 degree bent route. Further, since the opening 4*c* is opened onto the linear route as mentioned above, and the applying body 4*x* for applying the mascara L flowing out of the opening 4*c* to the cilia is structured such as to be provided with a plurality of arch type applying portions 4*e* which are arranged in line along the opening 4*c* while straddling the opening 4*c* from the outer side and have the arch shape, the mascara L is more evenly distributed between the adjacent arch type applying portions 4*e* and 4*e* in comparison with the conventional art in which a plurality of slits are provided in line along the direction in which the mascara flows into the head, and it is possible to apply the mascara L to the cilia without unevenness.

In this case, taking into consideration a rapid flow of the mascara L, shapes of an inflow port and an outflow port of the mascara L in the guide path 34*d* (the opening in the rear end and the opening 4*c* in the front end of the guide path 34*d*) are preferably made in similar shapes, and more preferably made in the same shape.

Further, in the present embodiment, since the applying body 4*x* has the chevron type applying portions 4*f* having the chevron shape at the outermost side positions in the in-line arranging direction of the arch type applying portions 4*e* which are provided in line, it is possible to prevent liquid dropping of the mascara L to the outer side in the in-line arranging direction by the chevron type applying portion 4*f*, and it is possible to more quickly achieve the state capable of applying the mascara L.

In this case, a plurality of arch type applying portions 4*e* may be formed in different outer shapes from each other. Specifically, for example, it is possible to mix and alternately arrange wide arch type applying portions in which a distance between both legs of a V-shape constructing the arch shape is wide, and narrow arch type applying portions in which the distance between both the legs of the V-shape is narrow, for example. Therefore, it is possible to apply makeup including several variations such as to easily make the cilia voluminous or the like regardless of a skill of a user.

Further, an inner cap may be provided within the cap 5, and a space within the inner cap may be reduced further, thereby further preventing dry.

The present invention is specifically described above on the basis of the embodiment thereof. However, the present invention is not limited to the embodiment mentioned above. For example, in the embodiment mentioned above, the opening 4*c* is formed in the rectangular shape. However, it may be formed in an approximately oval shape or an approximately elliptic shape.

Further, in the embodiment mentioned above, the guide path 34*d* is constructed by the inner peripheral surface (the tube hole) 3*d* of the induction portion 3 and the inner peripheral surface (the tube hole) 4*d* of the front tube portion 4. However, it may be constructed only by the inner peripheral surface (the tube hole) of the front tube portion, or the induction portion 3 may be extended to the front end side so that it is constructed only by the inner peripheral surface (the tube hole) of the induction portion.

Further, in the embodiment mentioned above, the description is given of the mascara applying device extruding the mascara L by the extruding mechanism. However, it can be applied to a squeeze type device such as a tube, a soft bottle or the like from which a content can be extruded by pressing force of a user.

In addition, conventionally, if the mascara is employed in the mascara applying device having the extruding mechanism as mentioned above and the squeeze type mascara applying device, it is solidified among the applying portions or the like after being used and can not be extruded due to its high hardness. However, in the present embodiment, the mascara which can be extruded without being solidified is used. A specific hardness of the mascara mentioned above is determined in accordance with the following measurement by the inventor of the present invention. As a result of measurement using a rheometer for measuring a hardness, using an applicator with a spherical body having a diameter 8 ϕ, and setting a needle entering speed to 6 cm/min, a needle entering distance to 10 mm and a measuring temperature to 25° C., the mascara which can be extruded without being solidified preferably has a hardness between 1 and 200, and more preferably has a hardness between 1 and 100.

The entire disclosure of Japanese Patent Application No. 2010-175594 filed Aug. 4, 2010, is expressly incorporated by reference herein.

What is claimed is:

1. A mascara applying device comprising:

a main body tube having an accommodating portion accommodating and extruding mascara;

an induction portion having a tube hole associated with the accommodation portion of the main body tube;

a front tube having a tube hole associated with the tube hole of the induction portion, and having a rectangular opening formed in a front end of the tube hole;

a guide path for guiding said mascara extruded from said accommodating portion to the opening of the front tube;

said guide path being defined by the tube hole of the induction portion and the tube hole of the front tube, and having a rectangular shaped section in a direction perpendicular to the axial direction to form a straight linear route extending up to the opening;

an applying body for applying said mascara flowing out of said opening to cilia, wherein said applying body is provided with a plurality of arch shaped applying portions, each applying portion being of a plate-shaped configuration with a uniform width in a longitudinal direction of the opening and includes a concave portion which extends toward a top thereof, and the applying portions are vertically arranged on a plane defined by the opening in a line along the longitudinal direction of said opening and straddling said opening across the outer, sides thereof.

2. The mascara applying device as claimed in claim 1, wherein said plurality of the arch shaped applying portions have different outer shapes from each other.

3. The mascara applying device as claimed in claim 1, wherein said applying body has at least one chevron shaped applying portion which inhibits said mascara from flowing out of an outer end of said longitudinally arranged arch shaped applying portions.

4. The mascara applying device as claimed in claim 1, wherein said applying body have plural chevron shaped applying portions which inhibit said mascara from flowing out of outer ends of said longitudinally arranged arch shaped applying portions.

* * * * *